United States Patent [19]

Takematsu

[11] 4,242,616

[45] Dec. 30, 1980

[54] PHOTOGRAPHIC FLASH APPARATUS

[75] Inventor: Yoshiyuki Takematsu, Tokyo, Japan

[73] Assignee: Fuji Koeki Corporation, Tokyo, Japan; a part interest

[21] Appl. No.: 902,755

[22] Filed: May 3, 1978

[30] Foreign Application Priority Data

May 14, 1977 [JP] Japan ..... 52/61829[U]

[51] Int. Cl.[3] ..... H05B 41/32

[52] U.S. Cl. ..... 315/241 P; 315/151; 315/152; 315/324; 354/132

[58] Field of Search ..... 315/151, 159, 241 P, 315/312, 313, 324, 152; 354/33-35, 132, 145

[56] References Cited

U.S. PATENT DOCUMENTS

| | | | |
|---|---|---|---|
| 2,351,603 | 6/1944 | Edgerton | 315/241 P |
| 3,113,495 | 10/1963 | Brandt et al. | 354/132 |
| 3,878,429 | 4/1975 | Iwata | 315/151 |
| 3,919,594 | 11/1975 | Mahlich et al. | 315/241 P |
| 4,068,245 | 1/1978 | Ohtaki et al. | 354/33 X |
| 4,078,240 | 3/1978 | Kaneko et al. | 315/241 P X |

FOREIGN PATENT DOCUMENTS

| | | | |
|---|---|---|---|
| 52-141938 | 10/1977 | Japan | 354/132 |

*Primary Examiner*—Eugene R. LaRoche
*Attorney, Agent, or Firm*—Fleit & Jacobson

[57] ABSTRACT

This invention discloses a electric flash apparatus comprising a flash housing which consists of a first casing and a second casing, each of which is pivotably connected, a first flashing member having at least one flash tube and arranged in said first casing, a second flashing member including at least one flash tube and arranged in the second casing, and a flash control circuit arrangement for controlling effectively quantity and a flash duration of flash light of said flash tubes.

14 Claims, 5 Drawing Figures

PHOTOGRAPHIC FLASH APPARATUS

FIELD OF THE INVENTION

The present invention relates to a flash apparatus, and more particularly to a photographic flash apparatus.

BACKGROUND OF THE INVENTION

In recent years, the flash apparatus has been widely employed in various kinds of optical apparatus which require light of the flash. Particularly, in the art of photography, artificial light is used to illuminate an object to be photographed. One form of artificial light which has been in wide use is the so-called electric flash device. In such devices, a flash tube is provided in order to illuminate the object to be photographed. The light from the flash tube can only be used to illuminate the object in order to take a picture. When the flash light from a photoflash is used to illuminate the object to be photographed, light and darkness appear on the photographic object in case there is uneveness on the surface of the photographic object. Furthermore, when the flash light from the photoflash is employed as a direct-light for illuminating the photographic object in a room or a photostudio, a shadow of the photographic object is formed behind the object and it is, therefore, not so preferable to take a picture in a practical use.

In order to eliminate the disadvantage of the photoflash device, it is known to take a picture by using means for generating bounce light. In taking a picture by means of the bounce light, there are, however, still disadvantages in that the quantity of the light incident on the photographic object is lowered compared with the predetermined value, particularly when a reflecting surface, such as the surface of ceiling is not so white, and in that the photographic object cannot be photographed so well when there is unevenness on the surface of the object to be photographed because the reflected light from the object does not in part, become incident on the film of the camera.

To eliminate the above disadvantages, there are required various kinds of high price devices such as, for example, a front light, an umbrella-shaped bounce light and a back-light for removing the shadow appearing at the background of the photographic object. This results in a package which is sufficiently bulky so as to preclude its portability, and as well is costly and uneconomical.

SUMMARY OF THE INVENTION

Among the several objects of the present invention may be noted the provision of a photographic flash apparatus which comprises a flash housing having a first casing and a second casing which is pivotably mounted on the first casing, a first flashing member having at least one flash tube and arranged in said first casing, a second flashing member having at least one flash tube and arranged in said second casing and a control circuit arrangement for triggering said first and second flash members and for controlling the quantitites of light of said first and second flash members; the provision of such electric flash apparatus which performs good flashing operations; the provision of such electric flash apparatus which is simple and compact structure; the provision of such electric flash apparatus which is reliable, and which is inexpensive and economical. Other objects and features will be, in part, apparent and, in part, pointed out hereinafter.

DESCRIPTION OF THE PREFERRED EMBODIMENT OF THE INVENTION

Figure 1:
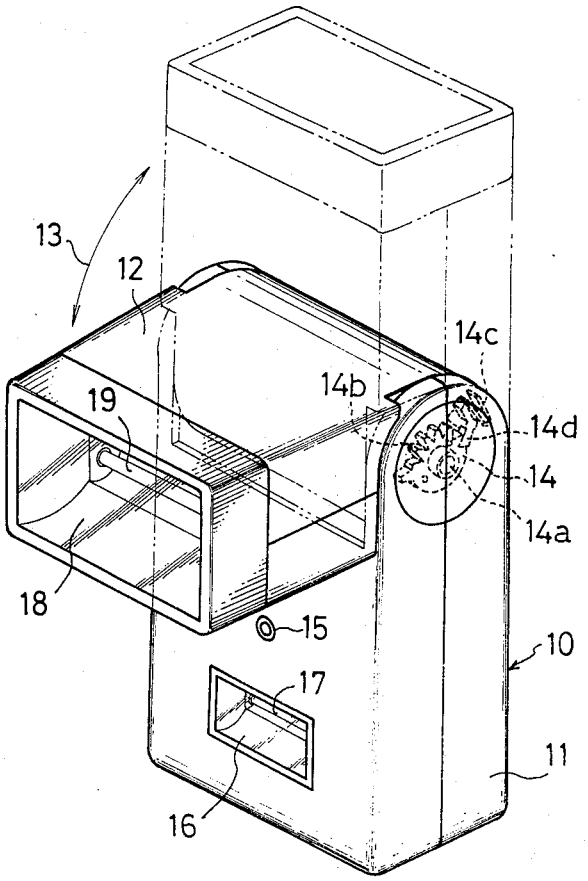
FIG. 1 is a perspective of an electric flash apparatus according to the present invention.

Referring to FIG. 1 of the drawing, there is shown a greatly simplified electric flash apparatus in accordance with the present invention. The electric flash apparatus has a flash housing, generally designated by numeral 10, which consists of a first casing 11 and a second casing 12. The second casing 12 is pivotably connected to a first casing 11 by means of a connecting member 14. The connecting member 14 is constructed by a conventional ratch mechanism. The ratch mechanism is constructed by a pin 14*a* which is fixed on the second casing 12 and which is pivotably engaged with the first casing 11, a ratch gear 14*b* which is fastened to the second casing 12 together with the pin 14*a*, a curved U-shaped plate spring 14*c* inserted into the first casing 11 and an engaging segment 14*d* which is provided between the plate spring 14*c* and the ratch gear 14*a*. Accordingly, the second casing 12 is rotatable, as is shown by an arrow 13, with respect to the first casing 11. The first casing 11 is equipped with a light sensitive element 15 and a first flashing member 16 which includes a first flash tube 17 on a surface thereof. The second casing 12 is also equipped with a second flashing member 18 which includes a second flash tube 19. Accommodated in the flash housing 10 is a flash control circuit arrangement which is constructed as shown in FIG. 2.

Figure 2:
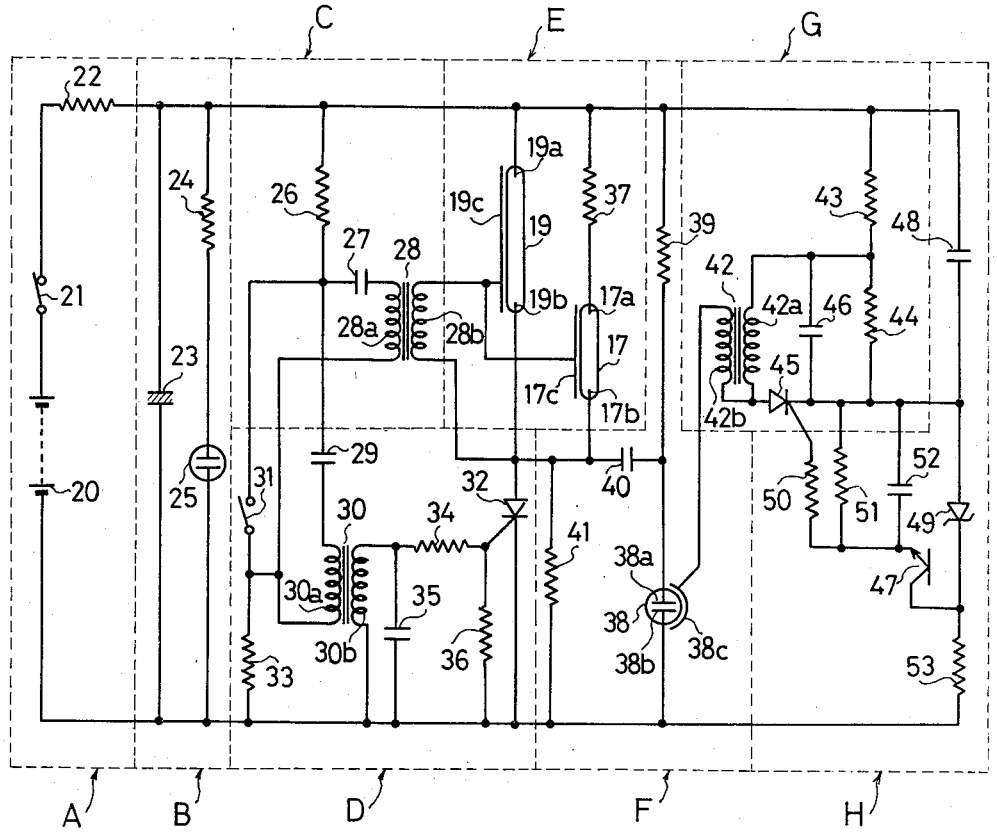
FIG. 2 is a detailed circuit diagram of a control circuit arrangement of an electric flash apparatus in accordance with the present invention.

As is best shown in FIG. 2, the flash control circuit arrangement comprises a power source circuit A, an electric charge storing circuit B for supplying the electrical energy to the flash tubes 17 and 19, a trigger pulse generating circuit C for triggering the flash tube member, a flash tube circuit E for generating a flash light, a switching circuit D for actuating the flash tube circuit E, a quenching circuit F for extinguishing the flash tubes of the flash tube circuit E, a quench trigger signal generating circuit G for actuating the quenching circuit F, and a light-sensitive circuit H for actuating the quench trigger signal generating circuit F.

In more detail, the power source circuit A includes a battery 20, a manually operated switch 21 and a resistor 22 connected in series with the battery 20 by way of the switch 21. The electric charge storing circuit B comprises a main storage capacitor 23 which is connected in parallel relationship to the battery 20 through the switch 21 and the resistor 22, and a charging level indicating lamp in the form of a neon tube 25 which is connected in series with a resistor 24, the tube 25 and resistor 24 being connected in parallel with the main storage capacitor 23. When the main storage capacitor 23 is charged up to a predetermined charging voltage, the neon tube 25 luminesces and indicates the "ready for flashing" condition.

The trigger pulse generating circuit C includes a trigger resistor 26, a trigger capacitor 27 and a trigger transformer 28. In the trigger pulse generating circuit C, one terminal of the trigger resistor 26 is connected to a positive terminal of the battery 20 by way of the resistor 22 and the switch 21. One terminal of the trigger capacitor 27 is connected to the other terminal of the resistor 26, and an input winding 28*a* of the trigger transformer 28 is connected to the other terminal of the trigger capacitor 27.

The switching circuit D includes a trigger capacitor 29, a pulse transformer 30, a synchronizing switch 31, a switching element in the form of a first thyristor 32, a protecting resistor 33, a gate resistor 34, a capacitor 35, and a resistor 36. The trigger capacitor 29 is connected to the trigger resistor 26, and an input winding 30*a* of the pulse transformer 30 is connected between the input winding 28*a* and capacitor 29. The synchronizing switch 31 is interposed between a juncture of the resistor 26 and the capacitor 27 and a juncture of the input windings 28*a* and 30*a*. The protecting resistor 33 is interconnected between a negative terminal of the battery 20 and a juncture of the synchronizing switch 31 and the input winding 30*a* of the pulse transformer 30. An output winding 30*a* of the pulse transformer 30 is connected between a gate electrode and a cathode electrode of the first thyristor 32 through the gate resistor 34. The switch 31 is mounted on a camera, and is closed in synchronism with a camera shutter opening operation, enabling the flash tube to be fired by the well-known operation of the flash trigger circuit.

The flash tube circuit E comprises a first flash tube 17, a second flash tube 19 and a current-limiting resistor 37 for restricting a flash current flowing through the first flash tube 17.

The first flash tube 17 is provided with a pair of main current conducting electrodes 17*a*, 17*b* and a trigger electrode 17*c* which is positioned adjacent but external to the flash tube 17. The second flash tube 19 is also provided with a pair of main current conducting electrodes 19*a*, 19*b* and a trigger electrode 19*c* which is also positioned adjacent but external to the flash tube 19. As explained in the foregoing in FIG. 1, the first flash tube 17 is arranged in the first flashing member 16 which is mounted on the surface of the first casing 11, and the second flash tube 19 is arranged in the second flashing member 18 mounted on an end portion of the second casing 12. One main current conducting electrode 19*a* of the second flash tube 19 is connected to one electrode of the main storage capacitor 23, and the other main current conducting electrode 19*b* is connected to an anode electrode of the thyristor 32 of the switching circuit D. The trigger electrode 19*c* of the second flash tube 19 is connected to one terminal of an output winding 28*b* of trigger transformer 28. One main current conducting electrode 17*a* is connected to the one electrode of the main storage capacitor 23 through the current-limiting resistor 37, and the other main current conducting electrode 17*b* is connected to the anode of the thyristor 32 together with the main current conducting electrode 19*b* of the second flash tube 19 and, therefore, the electrodes 17*b* and 19*b* are connected to the other electrode of the main storage capacitor 23 by way of the first thyristor 32. The trigger electrode 17*c* of the first flash tube 17 is connected to the output winding 28*b* of the trigger transformer 28 together with the trigger electrode 19*c* of the second flash tube 19, so that the first flash tube 17 and the second flash tube 19 are simultaneously triggered by the triggering signal from the triggering pulse generating circuit C.

There are certain criteria, in the flash tube circuit E, that must be met in both flash tubes 17 and 19. To operate effectively, the current to be supplied to the first flash tube 17 must be a relatively low value compared with that to be supplied to the second flash tube 19 in order to make the quantity of the flash light generated from the first flash tube 17 smaller than that of the flash light from the second flash tube 19. To satisfy this requirement, the first flash tube 17 must have a relatively low impedance compared with the second flash tube 19. To provide such low impedance, the first flash tube 17 should have a low gas pressure and a short electrode spacing. On the other hand, when the first flash tube 17 has a low impedance compared with the second flash tube 19, an initiation of flashing of the first flash tube 17 occurs earlier than that of the second flash tube 19. To supply such low current and to adjust the flash durations of the flash tubes 17 and 19, the current-limiting resistor 37 is connected to the first flash tube 17. Additionally, although the flash tube circuit E employs the resistor 37 as the current-limiting element, the invention is not limitted to this, and a choke coil may also be employed.

The quenching circuit F includes a quench tube 38 for quenching the flash tubes 17 and 19, a resistor 39, a commutation capacitor 40 and a commutation resistor 41. The quench tube 38 is connected to both electrodes of the main storage capacitor 23 through the resistor 39. The commutation capacitor 40 is connected between a juncture of the resistor 39 and the quench tube 38 and the anode electrode of the thyristor 32, and the commutation resistor 40 is connected in parallel relationship to the thyristor 32 between the anode electrode and the cathode electrode thereof.

There are, of course, certain criteria that must be met in quench tube 38. To operate effectively, the quench tube 38 must have a further low impedance compared with the second flash tube 19. The second flash tube 19 has a minimum impedance of typically 1.5 to 2 ohms. Thus, the quench tube 38 should have an impedance near 0.1 ohm. To provide such low impedance, the quench tube 38 also should have a low gas pressure and a short electrode spacing. The electrodes 38*a* and 38*b* must be capable of carrying a very high current for a short time. The tube 38 must be capable of being triggered rapidly and easily into conduction over the range of voltages experienced by the flash tubes 17 and 19 during the flash. The quench tube 38 includes a trigger electrode 38*c* spaced midway between the two main electrodes 38*a* and 38*b*.

The quench trigger signal generating circuit G comprises a quench trigger transformer 42, two series connected resistors 43 and 44, a second switching element in the form of the thyristor 45 having its anode electrode connected to an input winding 42*a* of the quenching transformer 42, and a quenching capacitor 46 which is connected in parallel with the resistor 44. An output winding 42*b* of the quenching transformer 42 is interconnected between the trigger electrode 38*c* of the quench tube 38 and a juncture of the input winding and the anode electrode of the thyristor 45.

The light sensitive circuit H comprises a light sensitive element in the form of a photocell 47, a capacitor 48 whose one electrode is connected to the positive electrode of the battery 20, a zener diode 49 connected between the capacitor 48 and the photocell 47, a gate resistor 50 connected between a gate electrode of the thyristor 45 and the photocell 47, parallel connected resistor 51 and capacitor 52, and a protecting resistor 53.

A circuit constructed in accordance with the foregoing description operates as follows.

When the switch 21 is closed, the electric charge is stored on the main storage capacitor 23 from the battery 20 by way of the switch 21 and the resistor 23. Simultaneously the triggering capacitors 27 and 29 are charged from the battery 20 through the trigger resistor 26. The electric charge is also accumulated on the capacitors 40, 46 and 48 from the battery 20. Under these conditions, the operation of the flash tube circuit E is initiated by the closing of switch 31 of the switching circuit D in synchronism with the camera shutter opening operation, enabling flash tubes 17 and 19. When the switch 31 is closed, the electric charge of the trigger capacitor 27 is discharged through the switch 31 and the input winding 28*a* of the trigger transformer 28, and the electric charge of trigger capacitor 29 is simultaneously discharged through the switch 31 and the input winding 30*a* of the trigger transformer 30. By the discharge of capacitor 27, a triggering pulse is generated from the output winding 28*b* of the trigger transformer 28. And, at the same, a gating pulse appears at the input winding 30*b* of the pulse transformer 30, by discharging of the capacitor 29.

The stored voltage on the main storage capacitor 23 also appears across the electrodes 17*a* and 17*b* of the first flash tube 17 and across the electrodes 19*a* and 19*b* of the second flash tube 19.

The triggering pulse from the output winding 28*b* of the trigger transformer 28 is applied to the trigger electrodes 17*c* and 19*c* of the tubes 17 and 19. The firing pulse from the output winding 30*b* of the trigger transformer 30 is applied to the gate electrode of the first thyristor 32 and the thyristor 32 is turned on. When the thyristor 32 becomes conductive, the first flash tube 17 initiates a flash discharge between the electrodes 17*a* and 17*b*, and, at the same time, the second flash tube 19 also initiates a flash between the electrodes 19*a* and 19*b*, because each trigger electrode 17*c* and 19*c* is commonly connected to the output winding 28*b* of the trigger transformer 28. Under normal operations heretofore, the flash continues until the main storage capacitor 23 has discharged through the tubes 17 and 19 to the point where the voltage will no longer support the flash across the tube 17 and 19. That usually requires about several milliseconds of time.

The light sensitive circuit H senses the flash lights from the tubes 17 and 19, and automatically adjusts the maximum time duration of the flash produced across the tubes 17 and 19. The maximum time duration of flash remains at that time determined by the discharge of the main storage capacitor 23 through the first and the second flash tubes 17 and 19.

More specifically, when the flash light is reflected into the photo cell 47 from the object being photographed, the resistance of the photocell 47 decreases rapidly following the incident flash of light. Since the decay time of the conductivity of photocell 47 is low relative to the flash interval, the photocell 47 in and of itself effectively integrates the incident light, converting that incident light into a voltage signal of increasing magnitude appearing at the protecting resistor 53, thence to the zener diode 49. When the signal at zener diode 49 has reached a predetermined and fixed breakdown voltage, the zener diode 49 becomes suddenly conductive, and a voltage is developed across the resistor 50, producing a sharp pulse of energy to the gate electrode of the thyristor 45. The sharp pulse applied to the gate electrode of the thyristor 45 causes that thyristor 45 to become suddenly conductive, effectively short-circuiting the capacitor 46. This, in turn, causes the capacitor 46 to discharge, thereby applying a sharp pulse of energy to the input winding 42*a* of the quench transformer 42. The transformer 42 transmits the triggering pulse from the output winding 42*b* thereof to the triggering electrode 38*c* of the quench tube 38. That triggering pulse causes the quench tube 38 to become instantaneously conductive.

When the quench tube 38 becomes conductive, electric charge of the commutation capacitor 40 also discharges through the quench tube 38 and the commutation resistor 41, and thereby the voltage is induced between both terminals of the commutation resistor 41 so as to cause positive polarity at the cathode electrode side of the first thyristor 32 after a time interval decided by a time constant of the capacitor 40 and the resistor 41. This induced voltage at the resistor 41 causes the first thyristor 32 to turn off. When the first thyristor becomes non-conductive, the first and the second flash tubes 17 and 19 are simultaneously and instantaneously extinguished because the main current conducting electrodes 17*b* and 19*b* of each of flash tubes 17 and 19 are commonly connected to the anode electrode of the first thyristor 32.

In this case, since the quench tube 38 has a much lower impedance, when conductive, than do the first flash tube 17 and the second flash tube 19, almost all of the stored energy in main storage capacitor 23 is discharged through the current-limiting resistor 39 and the quench tube 38, causing the first flash tube 17 and the second flash tube 19 to be extinguished at such time as sufficient light has been reflected onto the photocell 47 to effect the initiation of the quenching.

Figure 3:
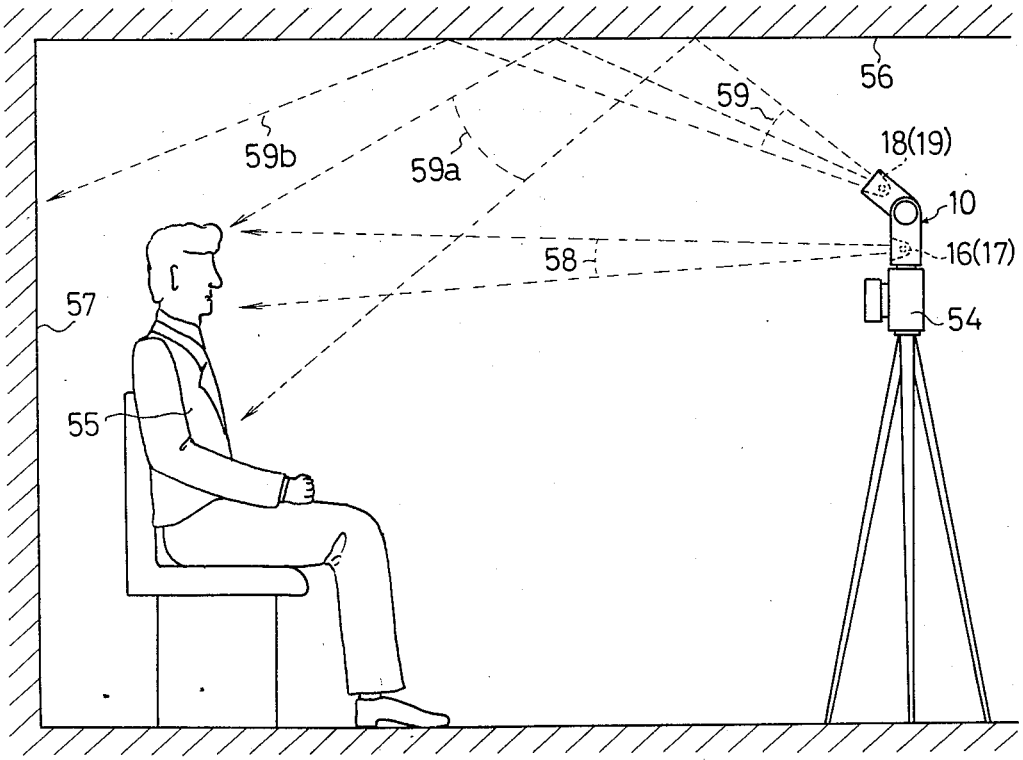
FIG. 3 is an elevational-side view for explaining the operation when bounce photographing is performed by using an electric flash apparatus in accordance with the present invention.

FIG. 3 shows an example of bounce photographing in a room or photo-studio, by using the electric flash apparatus in accordance with the present invention. As is best shown in FIG. 3, the flash housing 10 is mounted on a camera 54. The first flashing member 16 of the first casing 11 is directed toward an object to be photographed such as, for example, a man 55. The second casing 12 is set with a suitable angle with respect to the first casing 11, and the second flashing member 18 is directed toward a ceiling 56 with a desired angle with respect to a surface of the ceiling 56, in order to apply the reflected flash light to the object to be photographed. That is to say, a flash light 58 from the first flashing member 16 is directed toward the man 55, and, on the other, a flash light 59 from the second flashing member 18 is directed toward the surface of the ceiling 56. The flash light 59 reflects at the surface of the ceiling 56 and forms the bounce light. One reflected light 59*a* of the flash light 59 is incident on the man 55, and the other reflected light 59*b* of the flash light 59 is incident on a background such as, for example, a wall 57 of the room. The one reflected flash light 59*a* is superimposed with the flash light 58 from the first flashing member 16 and, on the other hand, the reflected light 59*b* eliminates the shadow in the background of the man 55.

Figure 4:
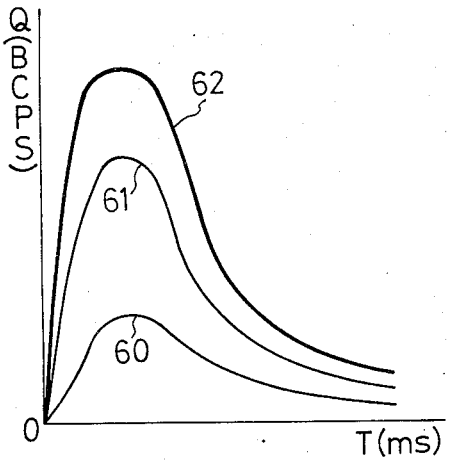
FIG. 4 is a graph showing a characteristic of the quantity of light produced from an electric flash apparatus in accordance with the present invention.

As discussed in the foregoing, the quantity of the flash light 59 is set so as to be greater than that of the flash light 58 produced from the first flash tube 17 by connecting the current-limiting resistor 37 thereto (see FIG. 2), as is best shown in FIG. 4, the characteristic of flash light quantity Q is on the order of Beam Candle Per Second (BCPS) with respect to Time T which is on the order of Millisecond (MS). In FIG. 4, a curve 60 denotes a flash light characteristic of the first light tube 17, a curve 61 designates a flash light characteristic of the second flash tube 18, and a curve 62 illustrates the resultant quantity which is the sum of the flash lights of the first flash tube 17 and the second flash tube 19. As is apparent from the curve 62 in FIG. 4, the total amount of the flash light produced from the flash apparatus in accordance with the present invention becomes greater than that of the conventional flash apparatus which has only one flashing member.

Figure 5:
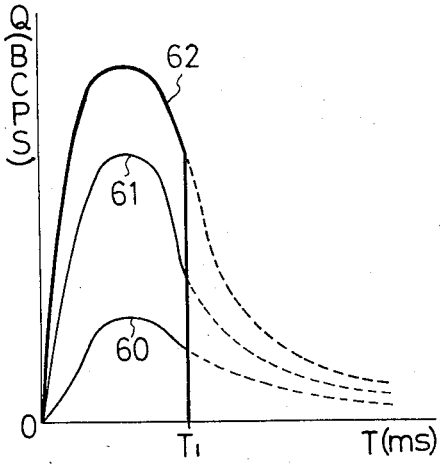
FIG. 5 is a graph showing a characteristic of the quantity of light, and denoting the operation of an electric flash apparatus according to the present invention.

Accordingly, in the photographing mode shown in FIG. 3, brightness of the object to be photographed, such as the man 55, increases and is made uniform. The flash durations of the first flash tube 17 and the second flash tube 19 are determined for the time interval $T_1$, as is shown in FIG. 5. The time interval $T_1$ is preselected in synchronism with the shutter operation of the camera 54. The flash durations of the tubes 17 and 19 are synchronized and set at the time point $T_1$, and each of the tubes 17 and 19 are simultaneously extinguished at the time $T_1$, as is shown in FIG. 5. Accordingly, the unnecessary flashing of the tubes 17 and 19 are avoided and, therefore, the flashing performance is enhanced. Thereby, the rated capacity of the main storage capacitor 23 is made small, although the apparatus is equipped with the first flash tube 17 and the second flash tube 19. Furthermore, as the total quantity of the flash light is summed by the light from the first flashing member 16 and the secod flashing member, the total quantity of light incident on the photographic object is enhanced and, as a result, the flash light is duly obtained in the photographic object.

The electric flash apparatus described hereinabove and illustrated by the Figures has the advantages of being very certain in operation and of enabling numerous discharges of flash tubes to be effected without replacing the various elements since the the triggering circuit member C is constructed by only one trigger transformer 28 and only one triggering capacitor 27.

The electric flash apparatus described hereinabove has, moreover, the advantage that the circuit construction is simplified and miniaturized, since the switching circuit D is commonly and effectively used for a plurality of flash tubes of the flash tube circuit E.

As is apparent from the hereinabove description, according to the present invention, the following advantages are obtained.

An advantage over the prior art flash apparatus is present in that the invention provides a new electric flash apparatus which can perform bounce photographing by means of setting an angle between a first casing and a second casing to the desired value, since the first casing and the second casing are rotatably connected to each.

Another advantage of the invention is that both a first flashing member and a second flashing member can also be used as a direct-light source by directing both of them toward the object to be photographed and, as a result, the quantity of incident light provided to the object increases to that extent.

A further advantage of the invention is that an electric flash apparatus is convenient to take a photograph, particularly to taking a picture by employing a bounce light, because a flash housing is rotatably constructed by a first casing and a second casing, each of the casings having a flashing member.

In view of the above, it will be seen that the several objects of the invention are achieved and other advantageous results attained.

While a preferred embodiment of the invention has been shown and described, it will be apparent to those skilled in the art that modifications can be made without departing from the principle and spirit of the invention, the scope of which is defined in the appended claims. Accordingly, the foregoing embodiment is to be considered illustrative, rather than restricting the invention, and those modifications which come within the meaning and range of equivalency of the claims are to be included herein.

What is claimed is:

1. A photographic flash apparatus comprising:

a flash housing consisting of a first casing having a first flashing member, wherein said first flashing member includes at least one first flash tube;

a second casing pivotably arranged with respect to said first casing and having a second flashing member, wherein said second flashing member includes at least one second flash tube; and a flash control circuit for controlling the flashing of said first and second flashing members, wherein said flash control circuit includes an electric charge storing circuit having a main storage capacitor for supplying electrical energy to said first and second flashing members, a trigger pulse generating circuit for triggering said at least one first and at least one second flash tubes of said first and second flashing members, respectively, a flash tube circuit for generating a light flash and being connected to said at least one first flash tube and said at least one second flash tube, and a switching circuit for actuating said flash tube circuit, wherein said flash tube circuit includes flash light quantity control means for controlling the quantity of the light flash of said first and second flashing members so that the light flash quantity of said first flash tube is always less than the light flash quantity of said second flash tube, and flash timing control means responsive to the resultant total light flash quantity of said at least one first and at least one second flash tubes attaining a predetermined value for stopping flash of the at least one first flash tube and at least one second flash tube such that flash durations of the at least one first and at least one second flash tubes become approximately the same.

2. A photographic flash apparatus as claimed in claim 1, wherein said means for controlling the light flash quantity of said at least one first and at least one second tubes includes current-limiting means for causing the current flowing in said at least one first flash tube to be less than the current flowing in said at least one second flash tube and for making the flash durations of the at least one first and at least one second flash tubes approximately the same.

3. A photographic flash apparatus as claimed in claim 1, further comprising:

quenching circuit means for extinguishing said at least one first and at least one second flash tubes of the flash tube circuit;

a quench trigger signal generating circuit for actuating said quenching circuit and for supplying a quench triggering signal to the quenching circuit; and a light sensitive circuit for sensing light flash from said first and second flashing members and for actuating the quench trigger signal generating circuit in response to said light flash.

4. A photographic flash apparatus as claimed in claim 1, wherein said trigger pulse generating circuit includes a first trigger capacitor and a trigger transformer having an input winding connected to said first trigger capacitor and an output winding connected to trigger electrodes of said first and second flash tubes.

5. A photographic flash apparatus as claimed in claim 1, wherein said switching circuit comprises:

a second trigger capacitor, a pulse transformer having an input winding connected to said second trigger capacitor and an output winding, a synchronous switch connected to said input winding of said pulse transformer together with an input winding of a trigger transformer of said trigger pulse generating circuit, and a switching element which is turned on by a signal from said output winding of said pulse transformer.

6. A photographic flash apparatus as claimed in claim 2, wherein said flash tube circuit is arranged such that the main current conducting electrodes of said at least one first flash tube are connected to a main storage capacitor of an electric charge storing circuit by way of a first switching element of a switching circuit and the triggering electrode of said at least one first flash tube is connected to an output winding of a trigger signal generating circuit, said flash tube circuit having a current-limiting element for restricting and for adjusting a flash current from said main storage capacitor between one main current conducting electrode and the other main current conducting electrode of said at least one first flash tube, said flash tube circuit being arranged such that the main current electrodes of said at least one second flash tube are connected in parallel to a series circuit of said at least one first flash tube and said current-limiting element, and the trigger electrode of said at least one second flash tube is connected to the output winding of a trigger transformer together with the trigger electrode of said at least one first flash tube.

7. A photographic flash apparatus as claimed in claim 6, wherein said current-limiting element is a resistor connected in series with said at least one first flash tube.

8. A photographic flash apparatus as claimed in claim 3, wherein said quenching circuit comprises a quench tube connected in parallel with a series circuit of said at least one first and at least one second flash tubes and switching element of the switching circuit, and a commutation circuit for turning off said first switching element.

9. A photographic flash apparatus as claimed in claim 3, wherein said quench trigger signal generating circuit includes a quench trigger transformer having an output winding connected to a triggering electrode of the quench tube of the quenching circuit and an input winding having a second switching element connected thereto.

10. A photographic flash apparatus as claimed in claim 3, wherein said light sensitive circuit includes a light sensitive element which becomes active in response to a predetermined quantity of light incident thereon and operates as said switching element of said quench trigger signal generating circuit.

11. A photographic flash apparatus as claimed in claim 5, wherein said first switching element is a thyristor.

12. A photographic flash apparatus as claimed in claim 8, wherein said commutation circuit includes a commutation capacitor interposed between a main current conducting electrode of said quenching tube and the anode electrode of the first thyristor, and a commutation resistor connected between the anode electrode and the cathode electrode of said first thyristor.

13. A photographic flash apparatus as claimed in claim 9, wherein said second switching element is a second thyristor connected in series to the input winding of said quench trigger transformer.

14. A photographic flash apparatus as claimed in claim 10, wherein said light sensitive element is a photocell connected to a gate electrode of the second thyristor by way of a gate resistor.

* * * * *